US011518592B2

(12) United States Patent
Bassi et al.

(10) Patent No.: US 11,518,592 B2
(45) Date of Patent: Dec. 6, 2022

(54) CLOSING CAP FOR A CONTAINER AND ITS PRODUCTION METHOD

(71) Applicant: SACMI COOPERATIVA MECCANICI IMOLA SOCIETA' COOPERATIVA, Imola (IT)

(72) Inventors: Vittorio Bassi, Faenza (IT); Alessandro Falzoni, Imola (IT)

(73) Assignee: SACMI COOPERATIVA MECCANICI IMOLA SOCIETA' COOPERATIVA, Imola (IT)

( * ) Notice: Subject to any disclaimer, the term of this patent is extended or adjusted under 35 U.S.C. 154(b) by 0 days.

(21) Appl. No.: 17/595,962

(22) PCT Filed: Jul. 27, 2020

(86) PCT No.: PCT/IB2020/057061
§ 371 (c)(1),
(2) Date: Nov. 30, 2021

(87) PCT Pub. No.: WO2021/019419
PCT Pub. Date: Feb. 4, 2021

(65) Prior Publication Data

US 2022/0204229 A1 Jun. 30, 2022

(30) Foreign Application Priority Data

Aug. 1, 2019 (IT) ..... 102019000013671

(51) Int. Cl.
*B65D 55/16* (2006.01)
*B65D 41/34* (2006.01)

(52) U.S. Cl.
CPC ..... *B65D 55/16* (2013.01); *B65D 41/3428* (2013.01)

(58) Field of Classification Search
CPC ..... B65D 55/16; B65D 41/3428
(Continued)

(56) References Cited

U.S. PATENT DOCUMENTS 4,394,918 A 7/1983 Grussen
6,474,491 B1 5/2002 Benoit-Gonin et al.
(Continued)

FOREIGN PATENT DOCUMENTS

EP 1124734 B1 7/2002
EP 1529736 A2 5/2005
(Continued)

*Primary Examiner* — James N Smalley
(74) *Attorney, Agent, or Firm* — Pearne & Gordon LLP

(57) ABSTRACT

Described is a closing cap (1) for a container (2), which comprises a lateral wall (3) extending about an axis (Z) and a transversal wall (4) positioned at an end of the lateral wall (3), a separation line (5) being provided on the lateral wall (3) to form a retaining ring (301), which is configured to remain anchored to a neck (201) of the container (2) and extends up to a free edge (304), and a closing element (302) removably engageable with the neck (201), so as to open or close the container (2). The separation line (5) extends about the axis (Z) and is circumferentially interrupted to form in the lateral wall (3) a joining zone (305), which extends for a first angle (a), in which the retaining ring (301) and the closing element (302) are joined. The cap (1) comprises a tab (308), made in the joining zone (305), which extends circumferentially for a second angle (β) and is connected to the joining zone (305); the retaining ring (301) comprising a retaining portion (303) and a free portion (306), wherein the retaining portion (303) comprises an engaging element configured to engage internally with a locking ring (202) of the neck (201) during a passage from a closed condition to an open condition of the closing element (302), and wherein the free portion (306) comprises a movement element which extends circumferentially at least in the second angle (β) and is configured, during said passage, to allow a movement of the free portion (306) along an axis parallel to the axis (Z).

16 Claims, 5 Drawing Sheets

(58) Field of Classification Search
USPC ..... 215/306
See application file for complete search history.

(56) References Cited

U.S. PATENT DOCUMENTS

| | | | | |
|---|---|---|---|---|
| 8,469,213 | B2 * | 6/2013 | Ishii | B65D 41/3428 220/837 |
| 10,654,625 | B2 * | 5/2020 | Migas | B65D 1/0246 |
| 11,312,544 | B2 * | 4/2022 | Maguire | B26D 1/0006 |

FOREIGN PATENT DOCUMENTS

| | | | |
|---|---|---|---|
| EP | 1529736 | A3 | 12/2008 |
| ES | 1217541 | U | 9/2018 |
| JP | 5330921 | B2 | 10/2013 |
| WO | 2020008092 | A1 | 1/2020 |

* cited by examiner

CLOSING CAP FOR A CONTAINER AND ITS PRODUCTION METHOD

The invention relates to a closing cap for a container and a relative production method.

The invention relates to a cap equipped with a retaining ring, which can be associated with a neck of the container, the cap being also equipped with a closing element which, after opening, remains connected to the retaining ring.

The cap according to the invention is particularly, but not exclusively, designed to be applied on bottles intended to contain liquid substances. There are prior art caps for bottles comprising a cup-shaped body equipped with an inner thread designed to engage with an outer thread of a neck of the bottle. The prior art caps are also equipped with a security ring connected to the cup-shaped body by means of a tear line equipped with a plurality of breakable elements, for example breakable bridges. When the cap is opened for the first time the cup-shaped body separates from the security ring along the tear line following breakage of the breakable bridges. The security ring remains associated with the neck of the bottle, whilst the cup-shaped body can be unscrewed by the user, which in this way separates the cup-shaped body from the bottle to access the contents of the bottle. Subsequently, the cup-shaped body can be re-screwed on the neck to reclose the bottle.

Sometimes, after the bottle has been emptied, the user throws the cup-shaped body on the ground, either intentionally or accidentally, whilst the bottle, together with security ring associated with it, should correctly be disposed of in a waste bin. This behaviour is obviously undesired.

To overcome this drawback, caps have been proposed which are equipped with a retaining ring, which can be associated with a neck of a bottle, and a closing element, connected to the retaining ring by means of a hinge.

The closing element can be rotated about the hinge between an open condition, in which a user can access the contents of the bottle, and a closed condition, in which the closing element prevents access to the bottle. The hinge keeps the closing element associated with the retaining ring and, therefore, the bottle, preventing the closing element from being thrown on the ground independently of the bottle.

The prior art caps equipped with hinge have however the drawback of being rather complicated to manufacture. In effect, the hinge is usually produced in the same mould in which the cap is obtained, particularly by injection moulding or compression moulding.

In order to produce the caps with hinge of known type it is therefore necessary to provide special moulds, different from those which are normally adopted for producing the caps free of the hinge. These moulds are more complicated than the ordinary ones, in particular because the caps with hinge of known type may be equipped with undercut parts, which thus require special means in order to be extracted from the mould.

Moreover, the caps with the hinge of known type and may have zones with a very reduced thickness, which are difficult to obtain because the molten polymeric material flows with difficulty in the portions of the mould intended to form these zones.

This increases the costs for the production of the caps with hinge and/or the cycle time necessary obtain them.

The prior art caps equipped with a hinge have, however, a further drawback linked to the fact that the retaining ring, in the open condition, when a user inclines the bottle to pour the contents, can easily rotate and cause the closing element connected to it to also fall downwards by gravity, which in this way can be positioned facing and below the dispensing opening. The user is therefore forced to manually lock the cap before inclining the bottle, in order to avoid undesired splashes or deviations of the content to be poured and have the guarantee that the closing element does not disturb the dispensing.

An aim of the invention is to improve the caps of known type, particularly the caps comprising a retaining ring designed to remain associated with a neck of the container and a closing element removably engageable with the neck to allow a user to open or alternatively close the container.

A further aim of the invention is to provide a cap for a container, equipped with a closing element which remains connected to the retaining ring, which in addition can remain stably locked in a position after opening.

Another aim of the invention is to provide a cap for a container, equipped with a closing element which remains connected to the retaining ring, which in addition can remain stably locked in a position after opening, which enables the production costs of the cap to be reduced.

According to the invention, there is a cap for a container according to claim 1 and the claims dependent thereon.

According to the invention, there is a method for making a cap for a container according to claim 15 and any claims dependent thereon.

In detail, according to the invention, there is a closing cap for a container, comprising a lateral wall extending about an axis and a transversal wall positioned at an end of the lateral wall, a separation line being provided on the lateral wall to define: a retaining ring, which is configured to remain anchored to a neck of the container and which extends up to a free edge; a closing element removably engageable with the neck, in such a way as to open or close the container; wherein the separation line is made about the wall and is interrupted about the axis and is circumferentially interrupted to define in the lateral wall a joining zone, which extends for a first angle, in which the retaining ring and the closing element are joined; wherein the cap comprises a tab, made in the joining zone, which extends circumferentially for a second angle and is connected to the joining zone; the retaining ring comprising: a retaining portion and a free portion, wherein the retaining portion comprises an engagement element configured for engaging internally with a locking ring of the neck during a passage from a closed condition to an open condition of the closing element, and wherein the free portion comprises a movement element which extends circumferentially at least in the second angle and is configured, during said passage, for allowing a movement of the free portion along an axis parallel to the axis.

Thanks to the joining zone, the closing element is stably associated with the retaining ring and, therefore, with the neck of the container in the open condition. This prevents the closing element from being thrown on the ground separately from the container. This thus increases the probability that the closing element, together with the container, is correctly disposed of together with waste of the same type, in particular together with plastic material waste.

Thanks to the tab, which is positioned in the joining zone and is connected to it, the closing element can be locked stably on the neck of the container, since a bottom edge of the tab rests on the neck and prevents the closing element from carrying out any rotational movement, both towards the dispensing opening and around the neck of the bottle.

Thanks to the free portion of the retaining ring, positioned at least circumferentially in the second angle in which the tab extends, the retaining ring can deform axially in the open condition of the closing element to allow the tab to rotate to rest on the neck whilst the engaging element of the retaining portion retains the cap anchored to the neck of the container.

Advantageously, the tab rests on the neck close to the locking ring. In this way, the closing element is locked in the movement towards the dispensing opening, since the tab interferes with the locking ring, or with zones of the neck close to it, and cannot rotate further. Moreover, the retaining ring is also locked in the rotation about the neck, due to the friction between the tab and the locking ring which prevents the tab from sliding laterally on the locking ring.

In one version, thanks to the fact that the tab can optionally bend relative to the hinge zone, it is guaranteed that the tab can adapt to the outer surface of the neck.

The closing element cannot, therefore, fall by gravity.

The user can close the bottle again only after disengaging the tab from the locking ring.

Advantageously, in order to obtain the tab, an incision line is made which extends between the separation line and the free edge of the retaining ring, which allows a bottom edge of the tab to be obtained.

In addition, cut lines are made on a lateral wall of the cap which extend transversally to the bottom edge, for making the side edges of the tab.

Consequently, the cap according to the invention may be produced in a relatively simple manner, without need to use special moulds. In effect, the cap according to the invention may be produced in a traditional mould such as a concave body and the incision line and the cut lines for making the side edges and the bottom edge of the tab may be made as cut lines by means of a cutting operation.

The method for making the cap is therefore simplified and this enables the production costs to be reduced.

The cutting operations may pass through the entire thickness of the lateral wall, or not pass through, if the thickness of the lateral wall is to be cut only partly.

Preferably, the incision line and the break lines are made by means of through cuts for an entire thickness of the lateral wall.

Optionally, there may be breakable elements on the cut line, designed to be broken the first time the cap 1 is brought to the open condition.

However, the incision line and the break lines can also be made by moulding, suitably shaping the mould in which the cap is produced, without, however, causing excessive complications of the mould, thanks to the particularly simple shape of the incision line and the cut lines. In this case, the incision line may also be shaped like a line of weakness.

In one version, the engagement element is made using a plurality of protruding elements which project from the free edge towards the inside and which have at most a first length.

In one version, the movement element is made as a movement wall which extends from a free edge of the retaining ring and is shorter than protruding elements of the retaining portion designed to make the engagement element.

In this way, during the passage from the closed condition to the open condition of the closing element, the moment in which the free portion engages with the locking ring is after the moment in which the retaining portion engages with the locking ring and depends on the length of the movement wall and on the position and/or the dimensions of the locking ring.

Advantageously, if the movement wall is short, the free portion never engages with the locking ring.

According to one version, if the free portion extends angularly for a third angle, which is greater than the second angle, the tab is interposed between a first free part and a second free part of the retaining ring, which can be inclined when the joining zone, together with the closing element, moves away from the retaining ring.

Advantageously, the first free part and the second free part define connecting bands between the retaining portion of the retaining ring and the joining zone.

Considering a centre line of the joining zone, a centre line of the tab coincides with the centre line of the joining zone and the connecting bands are positioned symmetrically relative to a plane containing the axis and the centre line of the joining zone.

The symmetrical shape of the tab, interposed between the first free part and the second free part, makes it possible to reduce the involuntary movements of the closing element when the cap is in an open condition and the closing element is locked resting on the neck close to the locking ring, in particular limiting the lateral movements. In this way, the cap cannot rotate.

It should also be noted that the joining zone, which also comprises the protruding tab, is robust so much that it is difficult to accidentally separate the retaining ring from the closing element.

The invention can be better understood and implemented with reference to the accompanying drawings which illustrate non-limiting example versions of it and in which.

Figure 1:
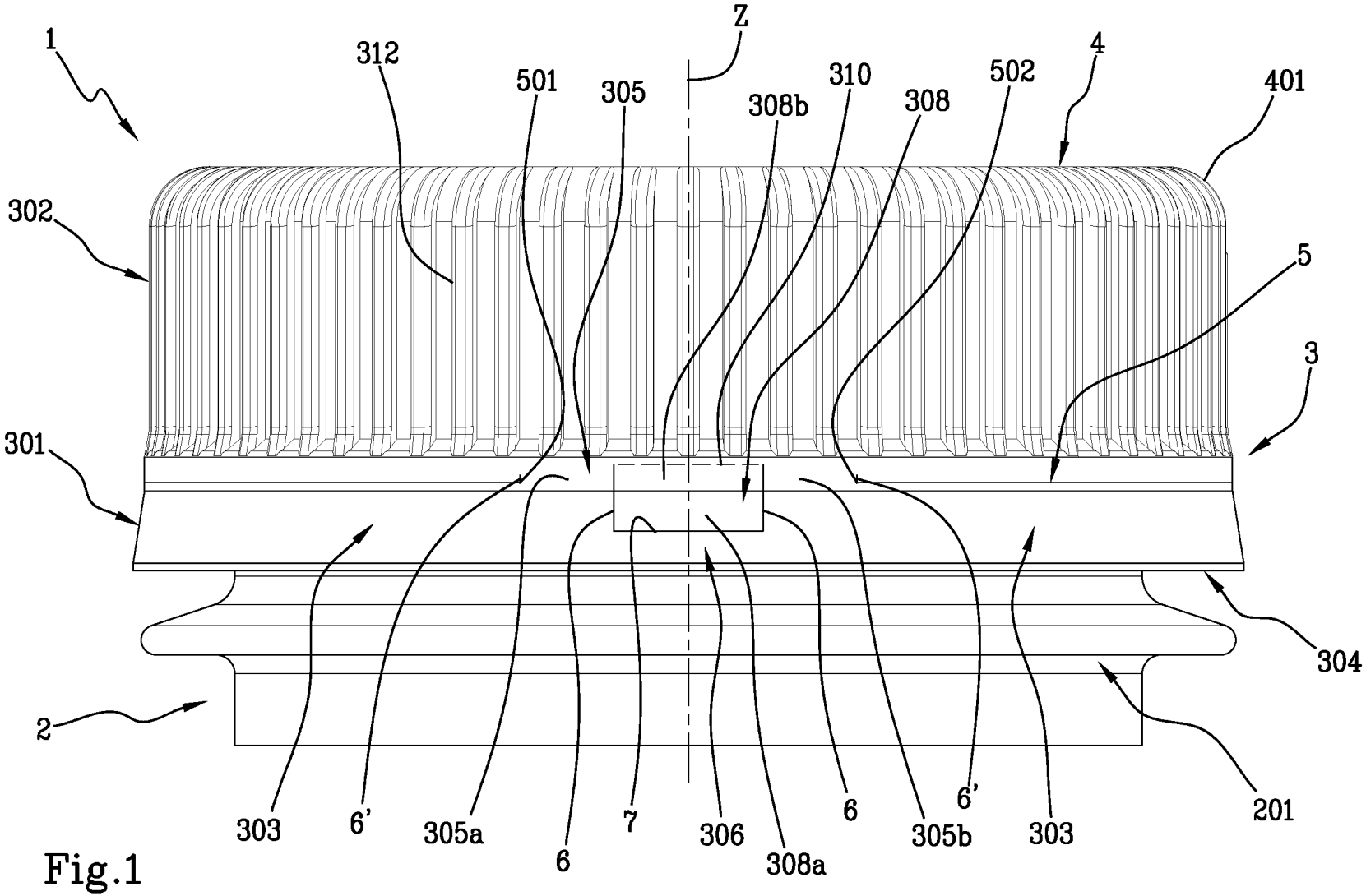
FIG. 1 is a side view of a closing cap for a container according to the invention, associated with a neck of a container comprising a closing element and a retaining ring, in a closed condition.

With reference to FIGS. 1 to 6, the numeral 1 denotes a cap for closing a container 2, of which only a neck 201 is shown, particularly a bottle designed to contain a liquid substance such as a drink.

It should be noted that elements common to the different embodiments will be indicated with the same reference numerals.

The cap 1 is made of polymeric material. Any polymeric material designed to be moulded can be used to obtain the cap 1.

The cap 1 is shown in FIG. 1 in a closed condition in which the cap 1 is located when it leaves a cap production line and is applied on the container 2. In this condition, the cap 1 comprises a lateral wall 3 which extends about an axis Z, and a transversal wall 4 located at an end of the lateral wall 3, so as to close the end. The transversal wall 4 extends transversally, in particular perpendicularly, to the axis Z. The transversal wall 4 may be flat, even though other shapes are theoretically possible. In the example illustrated, the transversal wall 4 has a substantially circular shape in plan view.

The lateral wall 3 and the transversal wall 4 define a cup-shaped body, designed to receive an end portion of the neck 201 of the container 2, so that the cap 1 can close the container 2.

More specifically, the lateral wall 3 is connected to the transversal wall 4 by a connecting zone 401, which may be shaped, in cross section, like a bevelled edge or a circular connector.

Figure 2:
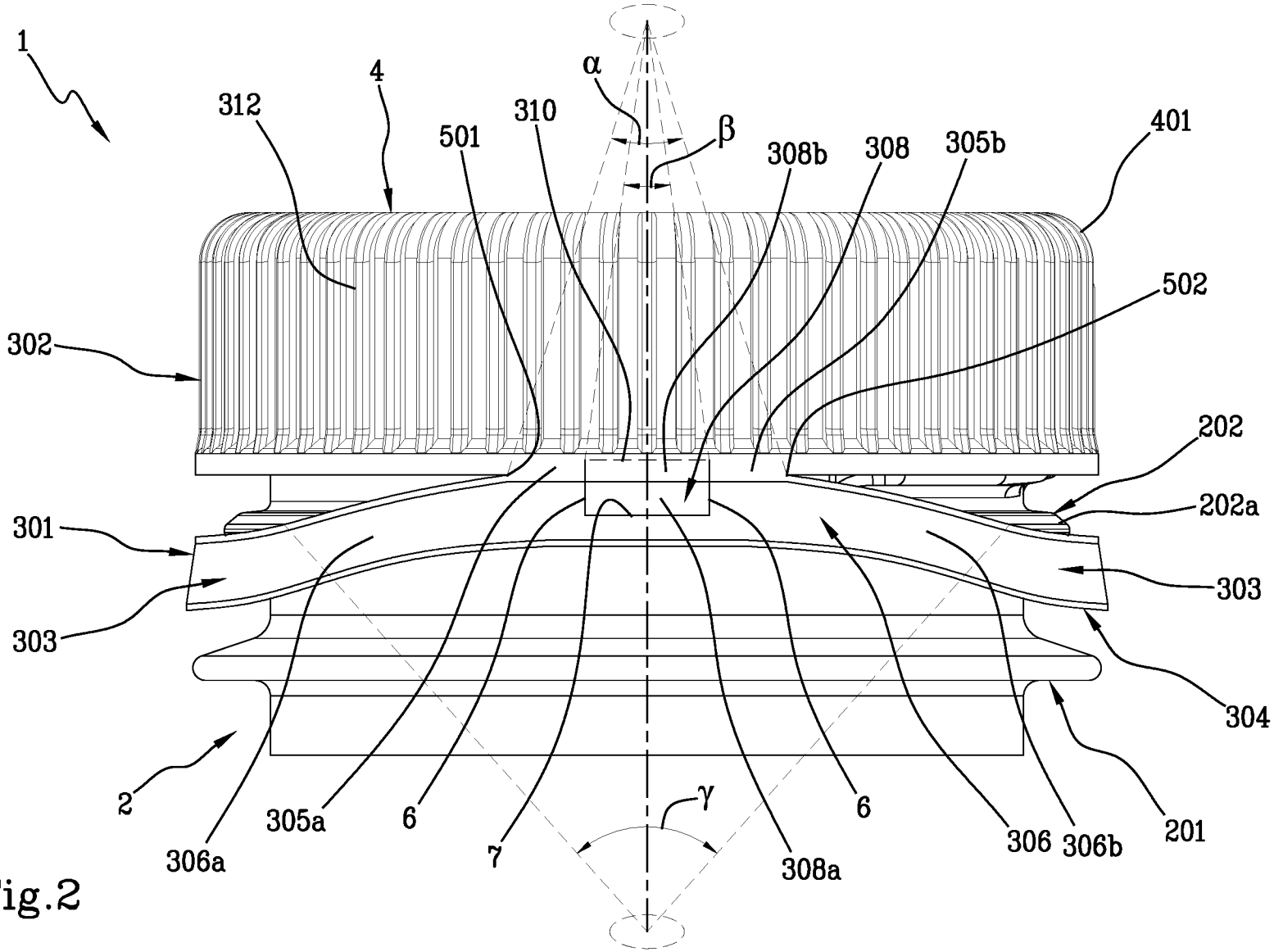
FIG. 2 is a side view of the cap of FIG. 1, during a passage from the closed condition to an open condition of the closing element, wherein the closing element starts to be separated from the retaining ring and the tab is still part of a joining zone between the closing element and the retaining ring.
Figure 3:
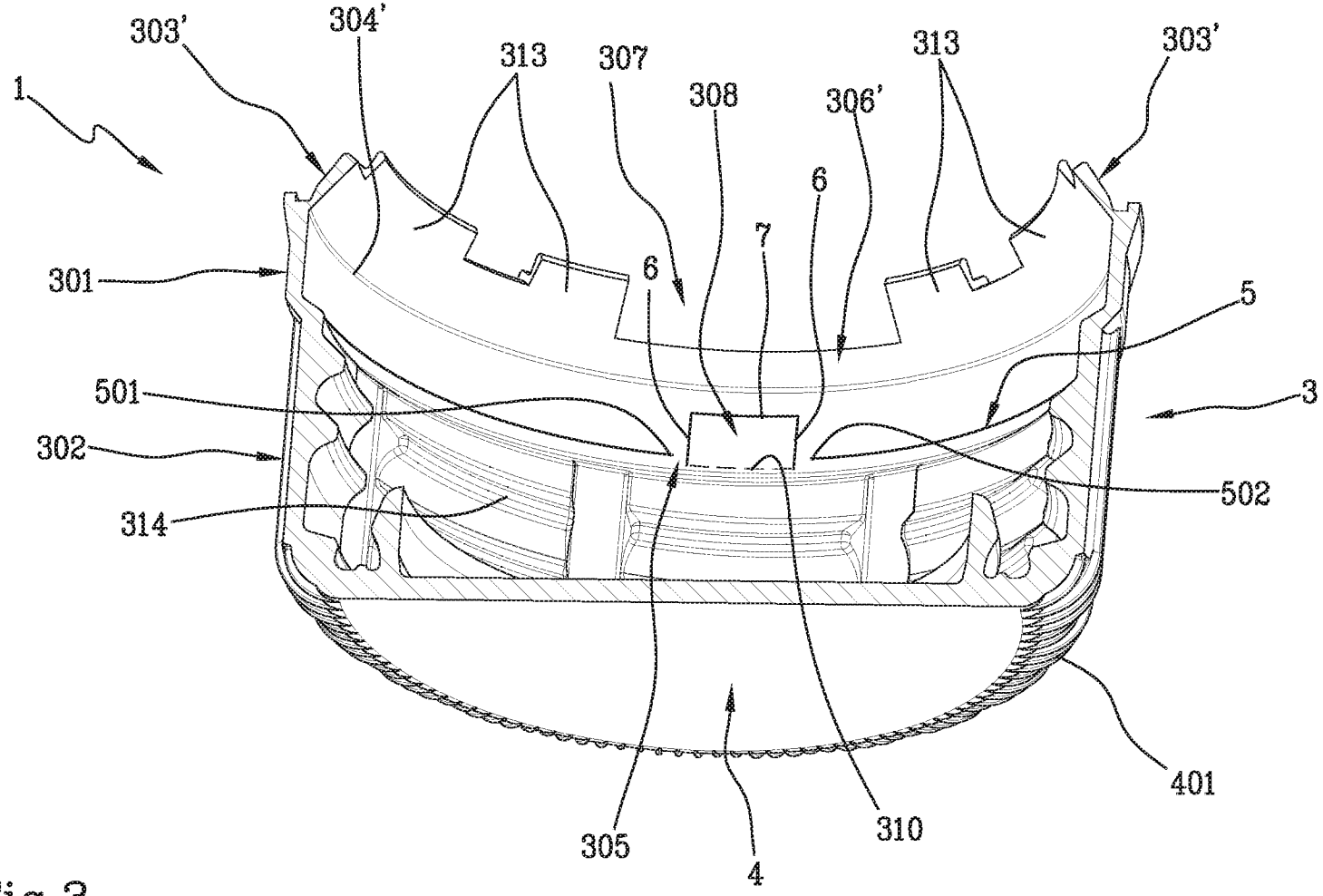
FIG. 3 is a perspective cross section view of an inside of the cap of FIG. 1, before being associated with a neck of a container, wherein the lateral wall comprises a first panel and a second panel, designed to be folded inside the cap 1.

The cap 1 comprises a separation line 5, shown in FIGS. 1 to 3, which is provided on the lateral wall 3 to define a retaining ring 301, which is configured to remain anchored to the neck 201 of the container 2 and extends up to a free edge 304.

More in detail, the retaining ring 301 is configured to engage internally with a locking ring 202 of the neck 201, in such a way as to remain anchored to the neck 201. The locking ring 202 is shown in FIG. 2 and in FIGS. 4 to 6 and projects from an outer surface of the neck 201.

The free edge 304 delimits the retaining ring 301 on the side opposite the transversal wall 4. The retaining ring 301 therefore extends between the separation line 5 and the free edge 304 and may be delimited by a cylindrical or truncated cone shaped outer surface. Preferably, the separation line 5 is parallel to the free edge 304.

The separation line 5, on the lateral wall 3, defines, in addition to the retaining ring 301, a closing element 302 removably engageable with the neck 201, so as to open or close the container 2. The closing element 302 can be engaged for closing a dispensing opening 203 of the container 2. The locking ring 202 is an annular enlargement, which extends in a plane positioned transversally to the axis Z.

The separation line 5 extends about the axis Z and is circumferentially interrupted to form in the lateral wall 3 a joining zone 305, which extends angularly for a first angle α, in which the retaining ring 301 and the closing element 302 are joined. More in detail, the separation line 5 extends between a first end 501 and a second end 502.

The cap 1 comprises a tab 308, made in the joining zone 305, which extends circumferentially for a second angle β and is connected to the joining zone 305.

More in detail, the tab 308 is connected to the joining zone 305 by a hinge zone 310 about which the tab 308 can, optionally, bend.

It should be noted that the angles α and β shown in FIG. 2, and also an angle γ which will be described in detail below, extend about the axis Z and have been shown as if the view of the cap 1 were from above and that is to say, from the side of the transversal wall 4.

The retaining ring 301 comprises a retaining portion 303 and a free portion 306.

The retaining portion 303 and the free portion 306 extend circumferentially for the entire retaining ring 301 and are explementary to each other.

The retaining portion 303 comprises an engagement element configured to engage internally with the locking ring 202 of the neck 201, during a passage from the closed condition to an open condition of the closing element 302.

The free portion 306 comprises, on the other hand, a movement element which extends circumferentially at least in the second angle β and is configured, during the passage from the closed condition to the open condition of the closing element 302, to allow a movement of the free portion 306 along an axis parallel to the axis Z.

In other words, thanks to the free portion 306, which extends circumferentially at least in the second angle β of the lateral wall 3 in which the tab 308 extends and comprises a movement element which allows a facilitated movement in an axis parallel to the axis Z, during the passage in the open condition, in which the joining zone 305 keeps the closing element 302 connected to the retaining ring 301, the tab 308 can rotate for resting on the neck 201.

The movement element allows this movement of the free portion 306 also in the open condition.

In effect, the tab 308 may optionally bend about the hinge zone 310 easily, since the free portion 306 is not retained by the locking ring 202, and the closing element 302 can rotate to rest on the neck 201 of the container 2 close to the locking ring 202.

It should be noted that, in the open condition, the joining zone 305 defines a hinge band which keeps connected the closing element 302 relative to the neck 201, deforming.

It should also be noted that the retaining portion 303 and the free portion 306 extend up to the free edge 304 of the retaining ring 301.

In other words, the retaining portion 303 and the free portion 306 are lower portions of the retaining ring 301, and therefore of the cap 1, when the cap is joined to the container 2.

As mentioned above, the retaining portion 303 is configured to retain anchored the retaining ring 301 to the neck 201 of the container 2.

When the cap 1 is associated with the container 2, the engagement element of the retaining portion 303 comprises a plurality of protruding elements (not illustrated) which project from the free edge 304 towards the inside.

The protruding elements have at the most a first length, measured as a distance from the free edge 304, which is suitably selected in such a way that they can engage with the locking ring 202 in the passage to the open condition of the closing element 302.

The movement element is made as a movement wall (not illustrated), which projects from the free edge 304 towards the inside and has a second length, less than the first length, defining a recess (not illustrated), which is interposed between circumferentially opposite ends of the retaining portion 303 and is delimited by the movement wall.

As illustrated in FIG. 3, before the cap 1 is associated with the container 2, the lateral wall 3 extends from the transversal wall 4 to a bottom ring 304' designed to make the bottom edge 304 of the cap 1. Beyond the bottom ring 304', a first panel 303' and a second panel 306' extend, designed to be folded inside the cap 1 to obtain, respectively, the retaining portion 303 and the free portion 306 of the retaining ring 301.

The first panel 303' is made as a wall which comprises a plurality of tabs 313 which, when folded inside the cap 1 define the respective protruding elements which project from the free edge 304 towards the inside and together define the engagement element of the retaining portion 303.

It should be noted that the maximum distance between the bottom ring 304' and an outer edge of the first panel 303', and that is to say, an end of the tabs 313, defines the first length of the protruding elements.

The second panel 306' extends between circumferentially opposite ends of the first panel 303' and defines, when it is folded inside the cap 1, the movement wall of the movement element.

The maximum distance between the bottom ring 304' and an outer edge of the second panel 306' defines the second length of the movement wall.

It should be noted that the second panel 306', which defines the movement wall of the free portion 306, is shorter than the first panel 303', which defines the retaining portion 303.

Since the second panel 306' is shorter than the first panel 303', between the opposite ends of the first panel 303' and the second panel 306' itself, there is a recess 307, which defines a respective recess of the movement element, when the second panel 306' is folded, and it is interposed between circumferentially opposite ends of the retaining portion 303.

In this way, during the passage from the closed condition to the open condition, when the protruding elements engage with the locking ring 202, the movement wall cannot intercept the latter.

It should be noted that, even though it has been shown as having a linear outer edge, the second panel 306' could have a different shape. For example, the second panel 306' might have further tabs, smaller than the tabs of the first panel 303' to form, once folded inside, a movement wall having further protruding elements, shorter in length than those of the engagement element.

The movement wall could, for example, engage in a delayed fashion with the locking ring 202 relative to the moment in which the protruding elements of the retaining portion 303, during the passage from the closed condition to the open condition of the closing element 302, engage with the locking ring 202. Alternatively, the movement wall could never intercept the locking ring 202, if it is preferable that the free portion 306 can move without constraints relative to the locking ring 202.

The movement wall makes it possible to reduce the possibility of deformations of the closing caps 1 during their transfer into the automatic capping lines.

In a further variant embodiment not illustrated, the movement element may be made only as a recess which extends as far as the free edge 304 and is interposed between circumferentially opposite ends of the retaining portion 303.

In other words, the second panel 306' may be completely absent and there may be only the recess 307 delimited by the opposite ends of the first panel 303' and by the bottom ring 304'.

Alternatively, according to a variant not illustrated, the engagement element may be shaped like a continuous or interrupted enlargement, which from an inner surface of the retaining portion 303 projects towards the axis Z to engage with the locking ring 202. In this case, the movement element of the free portion 306 may be made like a wall in which the enlargement is absent.

The retaining portion 303 is, therefore, circumferentially interrupted to define at least in the second angle β of the joining zone 305, in which there is the tab 308, the free portion 306, in which the retaining ring 301 does not remain anchored to the locking ring 202. Since the free portion 306 is at least part of the joining zone 305, and since the latter is in turn connected to the closing element 302, the free portion 306 is connected to the closing element 302, but can deform when the closing element 302 is in the open condition since it is not retained by the locking ring 202.

In a version, shown in FIG. 2, the free portion 306 extends for the third angle γ, with an extension at least equal to the first angle α.

In other words, the free portion 306 may extend at least in the entire joining zone 305, to define a large zone not retained by the locking ring 202. The free portion 306 may also extend beyond the joining zone 305.

It may be noted that in the retaining ring 301, the tab 308 is interposed between a first end zone 305*a* and a second end zone 305*b* of the joining zone 305, circumferentially positioned on the opposite side relative to the tab 308.

The first end zone 305*a* and the second end zone 305*b* are immediately adjacent to the first end 501 and to the second end 502 of the separation line 5, respectively.

Between the first end zone 305*a* of the joining zone 305 and the retaining portion 303, there is a first free part 306*a* of the retaining ring 301 which defines a first connecting band, visible in FIG. 2, during a passage from the closed condition to the open condition of the closing element 302.

Similarly, in the same passage in the open condition, between the second end zone 305*b* of the joining zone 305 and the retaining portion 303, there is a second free part 306*b* of the retaining ring 301 which defines a second connecting band.

The first free part 306*a* and the second free part 306*b* are all the greater the greater the third angle γ is relative to the first angle α.

The first free part 306*a* and the second free part 306*b*, the joining zone 305 and the tab 308, define a hinge arrangement which has a capacity of movement, in an axial direction, considerably greater than the capacity of movement which would be allowed only by the retaining portion 303. This hinge arrangement allows the closing element 302 to be moved away from the retaining portion 303 of the retaining ring 301 along a significant axial distance, determined by the combination of the joining zone 305 and the length of the first free part 306*a* and the second free part 306*b*, which can be deformed axially.

In effect, as may be noted in FIG. 2, the first free part 306*a* and the second free part 306*b* of the retaining ring 301 can be inclined following the closing element 302 which moves away from the neck 201 of the container 2 and connect the closing element 302 to the retaining portion 303, locked by the locking ring 202. The closing element 302 can be easily disengaged from the neck 201 of the container 2, since the capacity of movement and deformation of parts of the retaining ring 301 can be used, that is, of the free portion 306.

Thanks to the fact that the tab 308 is interposed between the first free part 306*a* and the second free part 306*b*, the tab 308 can be easily rotated together with the closing element 302 to be placed on the neck 201.

Figure 4:
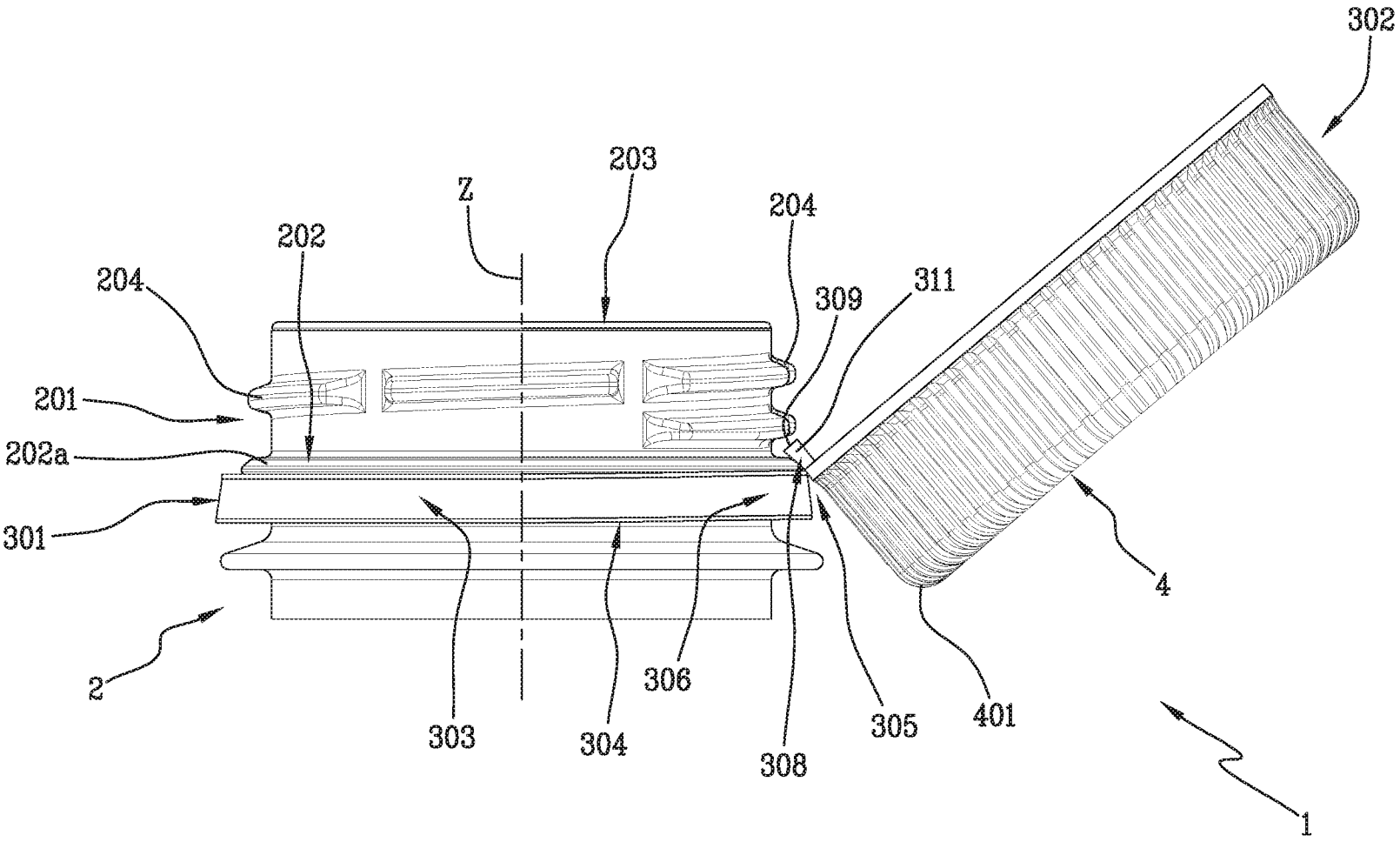
FIG. 4 is a side view of the cap of FIG. 1 in an open configuration, wherein the closing element is spaced from the neck of the container and the tab is locked resting on the neck, close to a ring for locking the neck.
Figure 6:
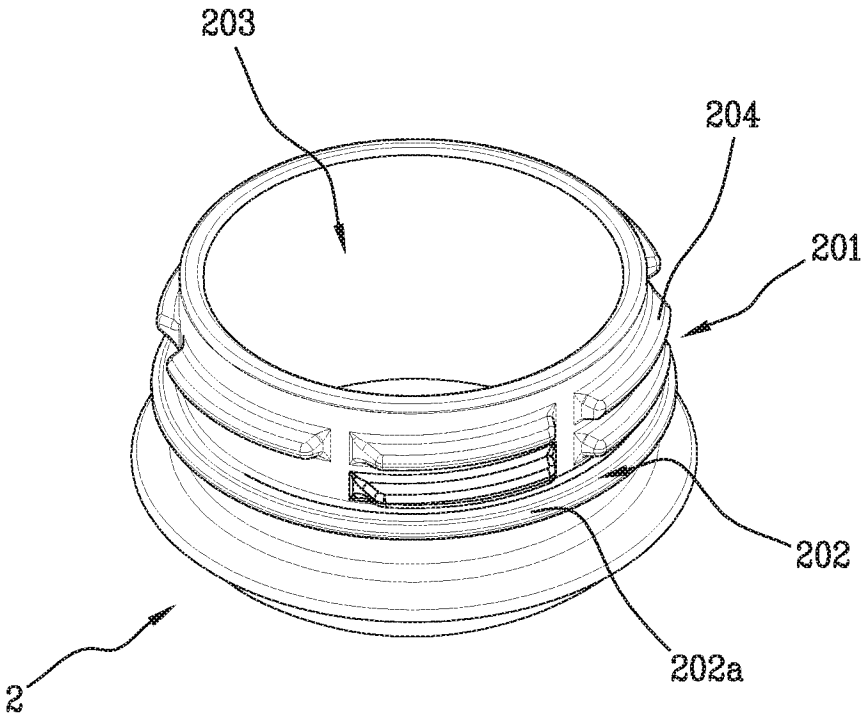
FIG. 6 is a perspective view of the neck of FIG. 5.

It should be noted that, in the open condition shown in FIG. 4, the hinge band comprises a first hinge element and a second hinge element defined at least partly, respectively, in the first end zone 305*a* and in the second end zone 305*b* of the joining zone 305, close, respectively, to the first end 501 and the second end 502 of the separation line 5.

The deformation of the hinge band affects exclusively the first hinge element and the second hinge element, but not the first free part 306*a* and the second free part 306*b* of the retaining ring 301, which can be inclined, but remain substantially undeformed and do not twist.

The tab 308 may be positioned centrally in the joining zone 305, as shown in FIGS. 1 to 3. In other words, the joining zone 305 may have a centre line which may coincide with a centre line of the tab 308.

However, according to a variant embodiment not illustrated, the tab 308 may be positioned offset in the joining zone 305 and therefore the first free part 306*a* may be of a different length relative to the second free part 306*b*, since it may extend for a different angular extension. In this case, the first free part 306*a* and the second free part 306*b* may be of different lengths.

As mentioned above, the tab can optionally bend about the hinge line 310. The hinge zone 310 is transversal to the axis Z and is positioned on the opposite side to a bottom edge 309, which is interposed between the hinge zone 310 and the free edge 304.

It should be noted that the hinge zone 310 is a virtual zone which defines in the lateral wall 3 a zone about which the tab 308 may optionally bend, which may also be part of the hinge band of the joining zone 305, relative to the length of the tab 308, or may be positioned closer to the free edge 304, or also on the lateral wall 3.

In addition, the tab 308 comprises a pair of lateral edges 311 which extend between the hinge zone 310 and the bottom edge 309, shown in FIG. 4.

The bottom edge 309 is transversal, in particular perpendicular to the axis Z, the lateral edges 311 are transversal to the bottom edge 309. In particular, the lateral edges 311 are parallel to each other, parallel to the axis Z and perpendicular to the bottom edge 309.

In other words, the tab 308 has a preferably rectangular shape wherein the bottom edge 309 is the free edge and, on the opposite side, has the hinge zone 310.

However, this condition is not necessary, since a different shape of the tab 308 is possible, which may, for example, have curved lateral edges 311 or inclined relative to the bottom edge 309.

On the lateral wall 3 there are two cut lines 6, shown in FIGS. 1 to 3, which extend parallel to each other and parallel to the axis Z which define the respective lateral edges 311 of the tab 308.

If the lateral edges 311 of the tab 308 are curved, the cut lines 6 from which it is possible to obtain the lateral edges 311 are also curved.

The cut lines 6 have the same height and have first ends, facing towards the transversal wall 4, between which the hinge zone 310 is defined.

As shown in FIG. 1, the hinge line 310 is positioned in the joining portion 305 of the lateral wall 3.

The tab 308 may have an outer part 308*a*, made in the retaining ring 303 and an inner part 308*b*, made in the closing element 302, which are separated, respectively, from the retaining ring 301 and from the closing element 302 by respective stretches of the lateral edges 311.

More in detail, the cut lines 6 may extend at least inside the closing element 302 to define the inner part 308*b* of the tab 308 and, therefore, the hinge zone 310 may be positioned in the closing element 302. In this case, the tab 308 has a considerable bending capacity since it has a large length, from the hinge zone 310 to the bottom edge 309.

Thanks to the free portion 306 positioned at least at the second angle β of the joining zone 305, in which there is the tab 308, the retaining ring 301 does not remain anchored to the locking ring 202.

It should be noted that the lateral wall 3 can be equipped, on a relative outer surface, with a plurality of knurling lines 312, extending parallel to the axis Z and designed to facilitate gripping of the cap 1 by the user or by the capping machine which applies the cap 1 on the container 2 to be closed.

The knurling lines 312 may be positioned in the closing element 302 but may also continue in the connecting zone 401 and/or in the retaining ring 301.

In the example shown, it should be noted that the lateral wall 3 comprises a cylindrical portion on which the knurling lines 312 are made which extend up to the connecting zone 401, a wide portion extending up to the free edge 304 of the retaining ring 301 and a connecting portion positioned between the cylindrical portion and the wide portion. The wide portion has a diameter greater than the cylindrical portion. The wide portion may be delimited by a smooth outer surface, that is to say, it may be without knurling lines, but this is not necessary since the knurling lines could also extend on the wide portion. The closing element 302 is defined by the cylindrical portion, the retaining ring 301 is formed by the wide portion since the separation line 5 is provided on the connecting portion. However, other configurations of the cap 1 might be possible, in relation to the position of the separation line 5 and the extension of the knurling lines 312.

The separation line 5 may be also positioned on the cylindrical portion.

For example, the cut lines 6 might extend up to the knurling lines 312 of the closing element 302 to obtain a hinge zone 310 positioned at the knurling lines 312.

The bottom edge 309 is made by means of an incision line 7, shown in FIGS. 1 to 3.

It should be noted that the separation line 5 lies on a separating plane, which is, in particular, perpendicular to the axis Z.

The bottom edge 309 is made by means of an incision line 7 which extends on a further plane, parallel to the plane of separation, which is interposed between the plane of separation and the free edge 304 of the retaining ring 301.

The incision line 7 defines the bottom edge 309 of the tab 308 and is, in this way, transversal to the axis Z and in particular is perpendicular to the axis Z.

It should be noted that the incision line 7 extends between the cut lines 6. As mentioned above, the joining zone 305 extends about the axis Z for the first angle α. The first angle α is between 20° and 90°, preferably between 20° and 40°. In other words, between the first end 501 and the second end 502 of the separation line 5 there is an angular distance of between 20° and 90°, preferably between 20° and 40°.

The incision line 7, which determines the width of the tab 308, extends about the axis Z for the second angle β which is between 10° and 60°, preferably between 20° and 40°, even more preferably equal to 25°. In other words, between the ends of the incision line 7 there is an angular distance of between 10° and 60°, preferably between 20° and 40°, even more preferably equal to 25°.

The free portion 306 extends for the third angle γ which is at least equal to the second angle β, but may also be at least equal to the first angle α. The third angle γ is between 10° and 150°, preferably between 30° and 150°. In other words, between the ends of the free portion 306 there is an angular distance of between 10° and 150°, preferably between 30° and 150°.

For example, if the third angle γ is greater than the first angle α, the third angle γ is even more preferably between 50° and 150°.

In effect, with this angular size, the free portion 306 is sufficiently extended to define at the sides of the tab 308 the first free part 306*a* and the second free part 306*b* which are able to allow freedom of axial movement to the tab 308 without adversely affecting the retaining of the closing element 302 by means of the retaining portion 303, which is sufficiently extended to anchor the locking ring 202 to the neck 201 of the container 2.

The distance between the first ends of the cut lines 6 and the incision line 7 defines the length of the tab 308.

Thanks to these angular distances, the tab 308 can be sufficiently flexible about the hinge zone 310 and moreover at the sides of the tab 308 there are the first free part 306*a* and the second free part 306*b* which define respective connecting bands, which are sufficiently long to allow the closing element 302 to be moved axially to move the tab 308 beyond an upper edge of the neck 201, when the cap 1 is opened, and to move the tab 308 to disengage from the locking ring 202, when the cap 1 is closed.

It should be noted that, preferably, the incision line 7 may be shaped like a through cut which passes through the entire thickness of the lateral wall 3, and that is to say, of the retaining ring 301. Alternatively, the incision line 7 may be shaped like a line of weakness not passing through the entire thickness of the lateral wall 3, but at which the thickness of the lateral wall 3 is very reduced relative to the surrounding zones to facilitate the fracture of the incision line 7 in the retaining ring 301.

Alternatively, breakable elements (not illustrated) may be positioned along the incision line 7.

Even if a user accidentally strikes the closing element 302, stressing it towards the container 2, the closing element 302 is locked spaced from the neck 201 and cannot move towards it since the tab 308 is locked in rotation towards a bottom of the container from the neck 201.

When the closing element 302 is in the open condition, between the closing element 302, positioned spaced from the neck 201, and an axis parallel to the axis Z and tangential to the lateral surface of the neck 201, an angle of opening is defined at least equal to 30°, which guarantees that the closing element 302 does not interfere with the dispensing of the contents of the bottle when the bottle is inclined.

The closing element 302 is positioned inclined and the shape of the locking ring 202 and/or the tab 308 can contribute to determining the inclination of the closing element 302.

If now a plane is considered passing through the axis Z, the joining zone 305 has a thickness substantially constant on a plane containing the separation line 5. In effect, no lightening or particular shapes of the lateral wall 3 of the cap 1 are necessary to make the joining zone 305.

Also considering a plane passing through the axis Z, it may be noted that the locking ring 202 has a triangular cross-section and has an upper wall 202*a*, facing towards the dispensing opening 203, which is inclined relative to a base wall 202*b* of the locking ring 202 facing towards a bottom of the container 2. The locking ring 202 has, in other words, the upper wall 202*a* with a frustoconical shape.

Figure 5:
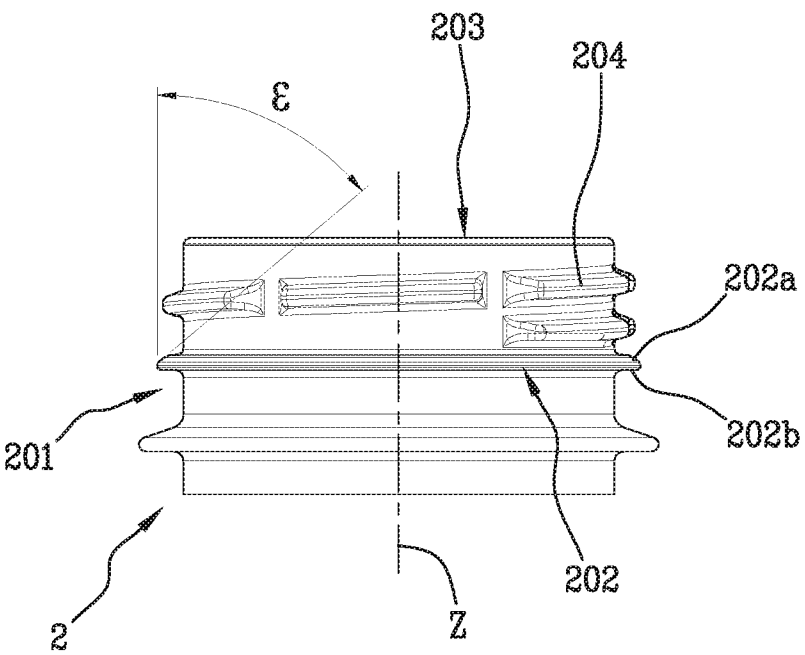
FIG. 5 is a side view of a neck of the container, without the respective closing cap.

An angle ε of 50°, shown in FIG. 5, is defined between an axis parallel to the axis Z, passing through an outer edge of the locking ring 202 and the upper wall 202*a*.

The inclination of the closing element 302 in the open condition may depend on:

- a length of the tab 308 along an axis parallel to the axis Z and, that is, a distance between the bottom edge 309 and the hinge zone 310;
- the angle α of inclination of the locking ring 202;
- a transversal extension of the locking ring 202 and, that is, a semi-difference between a diameter of the locking ring 202 and a diameter of the outer surface of the neck 201, immediately above the locking ring 202.

The separation line 5 extends on a plane positioned transversally, in particular perpendicularly, to the axis Z. It should be noted that the retaining ring 301 and the closing element 302 are positioned on opposite sides of the separation line 5.

The lateral wall 3 of the cap 1 is equipped internally with a coupling structure 314, configured for removably couple the closing element 302 to the neck 201 of the container 2, in such a way that the cap 1 can be moved from the closed condition, wherein the cap 1 closes the dispensing opening 203 of the container 2, to the open condition.

The coupling structure 314 of the cap 1 is positioned inside the closing element 302 and is shaped to engage with a corresponding coupling structure 204 present externally on the neck 201 of the container 2. The coupling structure 314 of the closing element 302 and the coupling structure 204 of the neck 201 are, as illustrated in the accompanying drawings, made as a thread. In this case, the movement from the closed condition to the open condition is performed by a rotation of the closing element 302 relative to the neck 201 of the container 2.

Advantageously, the tab 308 rests on the neck 201 close to the locking ring 202. In effect, with regard to the shape of the retaining ring 202 and/or of the tab 308, the inclination of the closing element 302 relative to the neck 201 is determined, which in turn determines the resting of the tab 308 on the neck 201.

The tab 308 can rest on the neck 201 in different positions of the neck. For example, the tab 308 can be rested:

- on the locking ring 202, since the locking ring 202 can define a lower contact element for the tab 308;
- in an outer zone of the neck 201 between the locking ring 202 and a lower thread of the thread 204;
- on the thread 204;
- in a further outer zone of the neck 201 immediately below the base wall 202*b* of the locking ring 202, since the locking ring 202 can form an upper contact element for the tab 308.

Along the separation line 5 there may be a plurality of breakable bridges, not illustrated, which connect the retaining ring 301 to the closing element 302. The breakable bridges are designed to be broken the first time the cap 1 is moved to the open position, to signal that the container is no longer whole. In this way, the closing element 302 separates from the retaining ring 301 along the separation line 5.

According to a variant not illustrated, the cap 1 comprises a pair of further cut lines 6' which extend, respectively, from the first end 501 of the separation line 5 and from the second end 502 of the separation line 5 inside the closing element 302. The further cut lines 6' may be inclined relative to an axis parallel to the axis Z, and therefore be inclined relative to the cut lines 6, but they may also have a different shape, for example curved, or be parallel to the cut lines 6.

These further cut lines 6' are short and may be present in the lateral wall 3 only to give greater flexibility to the joining zone 305, and therefore to the tab 308.

In use, at the end of a moulding procedure, a concave body is obtained from which it is possible to obtain a cap 1 as shown in FIG. 3, which has the lateral wall 3 which extends from the transversal wall 4 to a bottom ring 304', beyond which extends the first panel 303' and the second panel 306' designed to make, respectively, the retaining portion 303 and the free portion 306, when the first panel 303' and the second panel 306' are folded inside the cap 1.

The cap 1 is applied on the neck 201 of the container 2 in the closed condition shown in FIG. 1 and is positioned in such a way that the engagement element provided inside the retaining ring 301, in particular on the retaining portion 303 is below the locking ring 202 present on the neck 201.

When the user wishes to open the container for the first time, the user grips the closing element 302 and rotates the closing element 302 about the axis Z, in order to unscrew the closing element 302 from the neck 201.

Initially, during the passage from the closed condition to the open condition, the closing element 302 and the retaining ring 301 are rotated together about the axis Z, and they simultaneously move together in a direction parallel to the axis Z, away from the neck 201.

This occurs until the engagement element of the retaining portion 303 abuts against the locking ring 202 provided on the neck 201. At this point, the locking ring 202 prevents the retaining portion 303 from rising further along the axis Z, acting as a stop for the movement of the retaining portion 303, and therefore of the retaining ring 301, away from the neck 201. The free portion 306, in which the movement element allows a facilitated movement in an axis parallel to the axis Z, may continue to follow the joining zone 305 and the closing element 302 away from the neck 201 of the container 2.

The closing element 302, which is unscrewed by the user, continues to move along the axis Z away from the neck 201 and draws with it also the free portion 306. The breakable bridges are thereby tensioned, until causing the failure. The closing element 302 consequently separates from the retaining ring 301 along the separation line 5, but remains joined to the retaining ring 301 at the joining zone 305. The first free part 306*a* and the second free part 306*b* of the retaining ring 301 are inclined following the closing element 302 and connect the closing element 302 to the retaining portion 303, locked by the locking ring 202.

If the user continues to unscrew the closing element 302, so as to further move the closing element 302 along the axis Z to remove it from the neck 201, the first free part 306*a* and the second free part 306*b* deform further and the tab 308, made in the joining zone 305, also moves away from the locking ring 202 whilst the first free part 306*a* and the second free part 306*b* are pulled upwards and incline relative to the joining ring 202 converging towards the joining zone 305.

The tab 308 also extends along an axis which is parallel to the axis Z.

Continuing to unscrew the closing element 302, the latter is disengaged from the thread 204 made on the neck 201, so that the container 2 can be opened. The retaining portion 303 of the retaining ring 301 remains, on the other hand, anchored to the neck 201.

Since the tab 308 is made in the joining zone 305, in order to be able to completely disengage the tab 308 from the neck 201 of the container 2, the closing element 302 must be further moved away from the neck 201.

However, the tab 308 may also optionally bend relative to the hinge zone 310 to disengage its bottom edge 309 from the upper edge of the neck 201. As mentioned above, the joining zone 305 defines a hinge band, which keeps connected the closing element 302 relative to the neck 201 and about which the closing element 302 can rotate away from the neck 201.

By moving the closing element 302 around the joining zone 305 and disengaging the tab 308 from the neck 201, it is possible to move the closing element 302 to a lateral position and spaced from the neck 201, as shown in FIG. 4, until locking the tab 308 resting on the neck 201.

The first hinge element and the second hinge element, in the open condition, deform.

The bottom edge 309 of the tab 308 intercepts the neck 201 and the tab 308 rests in the proximity of the locking ring 202 of the neck 201 since the locking ring 202 prevents the tab 308 from rotating further.

The bottom edge 309 of the tab 308 faces towards the dispensing opening 203 of the container 2 and the tab 308 prevents the closing element 302 from accidentally rotating again towards the neck 201 and about it.

After use, the user can return the cap 1 from the open condition to the closed condition shown in FIG. 1 by a sequence of operations opposite to that described above.

In order to disengage the tab 308 from the locking ring 202, the user must firstly move the closing element 302 away from the neck 201, further deforming the first free part 306*a* and the second free part 306*b*, in the same direction as the upper wall 202*a* of the locking ring 202, if the tab 308 has rested on the locking ring 202, or between the thread 204 and the locking ring 202.

In fact, the particular shape of the hinge arrangement, and that is to say, of the joining zone 305, of the tab 308, of the first free part 306*a* and of the second free part 306*b*, is particularly suitable for being deformed in a direction of inclination parallel to the upper wall 202*a*, so that the user can disengage the tab 308 by sliding it on the upper wall 202*a* of the locking ring 202 when pulling the closing element 302 away from the container 2.

It should be noted, however, that the hinge arrangement according to the invention, including the tab 308, may also be advantageously applied to containers 2 having a locking ring 302 of different shape.

Subsequently, the user can reapply the closing element 302 on the neck 201, rotating the closing element 302 around the joining zone 305 and axially moving the closing element 302 away from the neck 201, before screwing again the closing element 302 on the thread 204.

During the closing of the container 2, the tab 308 is not an obstruction since it is positioned parallel to the outer surface of the neck 201.

To make a cap 1 for a container 2 according to the invention, a method is provided which comprises the following steps:

- providing a lateral wall 3 of the cap 1 extending around an axis Z and a transversal wall 4 positioned at one end of the lateral wall 3;
- cutting a separation line 5 on the lateral wall 3 which extends around the axis Z to define:
  - a retaining ring 301, configured for anchoring the retaining ring 301 to the neck 201;
  - a closing element 302 removably engageable with the neck 201, so as to open or close the container 2;

wherein the step of cutting the separation line 5 comprises interrupting the cut, to leave joined the retaining ring 301 and the closing element 302 in a joining zone 305, which extends angularly for a first angle $\alpha$; wherein the method comprises the step of

- making a tab 308 in the joining zone 305, which extends circumferentially for a second angle $\beta$ and connect the tab 308 to the joining zone 305; and wherein the method also comprises the step of providing in the retaining ring 301 a retaining portion 303 and a free portion 306, wherein in the retaining portion 303 there is an engaging element configured for engaging internally with a locking ring 202 of the neck 201 during a passage from the closed condition to the open condition of the closing element 302, and wherein in the free portion 306 there is a movement element which extends circumferentially at least in the second angle $\beta$ and is configured to allow a movement of the free portion 306 along an axis parallel to the axis Z during said passage.

The method also comprises the step of connecting the tab 308 to the joining zone 305 by means of a hinge zone 310 about which the tab 308 may optionally bend.

The method comprises the step of making an incision line 7, which extends between the separation line 5 and the free edge 304 in a further plane parallel to a separating plane containing the separation line 5, to define a bottom edge 309 of the tab 308.

In order to make the incision line 7, the method comprises using cutting tools positioned transversally to the axis Z.

The method may comprise making the incision line 7, for example, by means of a cutting operation passing through an entire thickness of the lateral wall 3.

If, during production of the cap 1, the axis Z of the cap is positioned vertically, then advantageously the incision line 7 may be obtained with horizontal cutting tools, after the cap 1 has been made, that is to say, with horizontal blades.

To obtain the lateral edges 311 of the tab 308, there is the step of making two cut lines 6 parallel to the axis Z and parallel to each other using cutting tools positioned parallel to the axis Z.

The method may comprise making the cut lines 6, for example, by means of a cutting operation passing through an entire thickness of the lateral wall 3.

Optionally, in order to give greater flexibility to the tab 308, there is the step of making a further pair of cut lines, which extend in the closing element 302 starting from the first end 501 and from the second end 502 of the separation line 5.

If the axis Z is positioned vertically, then the cut lines 6 can be obtained with vertical cutting tools and that is to say, vertical blades can be used after the cap 1 has been made.

The horizontal blades may be used in a first cutting station, not illustrated, and the vertical blades in a second cutting station, not illustrated, that is to say, to cut horizontally and vertically in succession the cap 1 grouping together the cutting tools transversal to the axis Z and the cutting tools parallel to the axis Z.

The cutting tools may also be suitably positioned transversally to the axis Z and/or the cutting tools positioned parallel to the axis Z in such a way as to make angularly in succession a cut line 6, the incision line 7 and the other cut line 6.

In particular, the cap 1 may be rotated about the axis Z, whilst the cutting tools are kept stationary, so as to bring consecutive zones of the lateral wall 3 to interact, in succession, with the horizontal and/or vertical blades.

It is also possible to keep the cap 1 stationary and to rotate the horizontal and/or vertical blades, to make the cut.

The blades positioned perpendicularly to the axis Z and the blades positioned parallel to the axis Z may cut simultaneously, or alternatively, relative to their position with respect to the lateral wall 3.

It should be noted, therefore, that in order to make the cap 1 according to the invention, traditional moulds can be used since the separation line 5, the incision line 7 and the cut lines 6 can be made as cut lines by means of a cutting operation in a simple and inexpensive manner.

The invention claimed is:

1. A closing cap (1) for a container (2), comprising a lateral wall (3) extending around an axis (Z) and a transversal wall (4) positioned at one end of the lateral wall (3), a separation line (5) being provided on the lateral wall (3) to define:

a retaining ring (301), which is configured to remain anchored to a neck (201) of the container (2) and extends as far as a free edge (304);

a closing element (302) removably engageable with the neck (201), so as to open or close the container (2); wherein the separation line (5) extends about the axis (Z) and is circumferentially interrupted to form in the lateral wall (3) a joining zone (305), which extends for a first angle (α), in which the retaining ring (301) and the closing element (302) are joined; wherein the cap (1) comprises a tab (308), made in the joining zone (305), which extends circumferentially for a second angle (β) and is connected to the joining zone (305); the retaining ring (301) comprising:

a retaining portion (303) and a free portion (306), wherein the retaining portion (303) comprises an engagement element configured to engage internally with a locking ring (202) of the neck (201) during a passage from a closed condition to an open condition of the closing element (302), the retaining portion (303) being circumferentially interrupted to define the free portion (306) at least in the second angle (β) in which the tab (308) extends, and wherein the free portion (306) comprises a movement element which extends circumferentially at least in the second angle (β) and is configured, during said passage, to allow a movement of the free portion (306) along an axis parallel to the axis (Z), wherein the retaining portion (303) and the free portion (306) extend up to the free edge (304) of the retaining ring (301) and wherein the engagement element of the retaining portion (303) comprises a plurality of protruding elements which project from the free edge (304) towards the inside and which have at most a first length.

2. The cap according to claim 1, wherein the free portion (306) extends for a third angle (γ), at least equal to the first angle (α).

3. The cap according to claim 1, wherein the tab (308) is connected to the joining zone (305) by a hinge zone (310), about which the tab (308) may optionally bend and comprises a bottom edge (309), which is positioned on the opposite side relative to the hinge zone (310) and is interposed between the hinge zone (310) and the free edge (304) of the retaining ring (301), and a pair of lateral edges (311), which extend from the hinge zone (310), the lateral edges (311) being transversal to the bottom edge (309).

4. The cap according to claim 3, wherein the tab (308) comprises an outer part (308*a*), made in the retaining ring (303) and an inner part (308*b*), made in the closing element (302), which are separated respectively from the retaining ring (301) and from the closing element (302) by respective stretches of the lateral edges (311).

5. The cap according to claim 3, wherein the lateral edges (311) are parallel to each other and parallel to the axis (Z) and wherein on the lateral wall (3) there are two cut lines (6) which extend parallel to the axis (Z) which define the respective lateral edges (311) of the tab (308), wherein the cut lines (6) are equal in length and have first ends between which is defined the hinge zone (310).

6. The cap according to claim 4, wherein the lateral edges (311) are parallel to each other and parallel to the axis (Z) and wherein on the lateral wall (3) there are two cut lines (6) which extend parallel to the axis (Z) which define the respective lateral edges (311) of the tab (308), wherein the cut lines (6) are equal in length and have first ends between which is defined the hinge zone (310), wherein the hinge zone (310) is positioned in the closing element (302) and wherein the cut lines (6) extend at least inside the closing element (302) to define the inner part (308*b*) of the tab (308).

7. The cap according to claim 5, wherein on the lateral wall (3) there are two further cut lines (6'), which extend inside the closing element (302) and wherein one extends from a first end (501) of the separation line (5) and the other extends from a second end (502) of the separation line (5).

8. The cap according to claim 1, wherein the free portion (306) extends circumferentially for a third angle (γ), which is between 10° and 150°, preferably between 30° and 150°, even more preferably between 50° and 150°.

9. The cap according to claim 1, wherein the second angle (β) is between 10° and 60°, preferably between 20° and 40°, even more preferably equal to 25°.

10. The cap according to claim 1, wherein the first angle (α) is between 20° and 90°, preferably between 20° and 40°.

11. The cap according to claim 1, wherein the tab (308) is connected to the joining zone (305) by a hinge zone (310), about which the tab (308) can optionally bend.

12. The cap according to claim 1, wherein the movement element is made as a movement wall, which projects from the free edge (304) towards the inside and has a second length, less than the first length, defining a recess (307) which is interposed between circumferentially opposite ends of the retaining portion (303) and is delimited by the movement wall.

13. The cap according to claim 1, wherein the movement element is made as a recess (307) which extends as far as the free edge (304), which is interposed between circumferentially opposite ends of the retaining portion (303) and is delimited by the free edge (304).

14. A method for making a cap (1) for a container (2) comprising the following steps:

providing a lateral wall (3) extending around an axis (Z) and a transversal wall (4) positioned at one end of the lateral wall (3);

cutting a separation line (5) on the lateral wall (3) to form:

a retaining ring (301), configured for anchoring the retaining ring (301) to the neck (201);

a closing element (302) removably engageable with the neck (201), so as to open or close the container (2);

wherein the step of cutting the separation line (5) comprises interrupting the cut, to leave joined the retaining ring (301) and the closing element (302) in a joining zone (305), which extends angularly for a first angle (a); wherein the method also comprises the step of making a tab (308) in the joining zone (305), which extends circumferentially for a second angle (β); and wherein the method also comprises the step of providing in the retaining ring (301) a retaining portion (303), for engaging internally with a locking ring (202) of the neck (201) during a passage from the closed condition to the open condition of the closing element (302) and a free portion (306), equipped with a movement element to allow a movement of the free portion (306) along an axis parallel to the axis (Z) during said passage.

15. A closing cap (1) for a container (2), comprising a lateral wall (3) extending around an axis (Z) and a transversal wall (4) positioned at one end of the lateral wall (3), a separation line (5) being provided on the lateral wall (3) to define:

a retaining ring (301), which is configured to remain anchored to a neck (201) of the container (2) and extends as far as a free edge (304);

a closing element (302) removably engageable with the neck (201), so as to open or close the container (2); wherein the separation line (5) extends about the axis (Z) and is circumferentially interrupted to form in the lateral wall (3) a joining zone (305), which extends for a first angle (a), in which the retaining ring (301) and the closing element (302) are joined; wherein the cap (1) comprises a tab (308), made in the joining zone (305), which extends circumferentially for a second angle (β) and is connected to the joining zone (305); the retaining ring (301) comprising:

a retaining portion (303) and a free portion (306), wherein the retaining portion (303) comprises an engagement element configured to engage internally with a locking ring (202) of the neck (201) during a passage from a closed condition to an open condition of the closing element (302), the retaining portion (303) being circumferentially interrupted to define the free portion (306) at least in the second angle (β) in which the tab (308) extends, and wherein the free portion (306) comprises a movement element which extends circumferentially at least in the second angle (β) and is configured, during said passage, to allow a movement of the free portion (306) along an axis parallel to the axis (Z), wherein the retaining portion (303) and the free portion (306) extend up to the free edge (304) of the retaining ring (301) and wherein the engagement element is shaped like a continuous or interrupted enlargement, which from an inner surface of the retaining portion (303) projects towards the axis (Z) to engage with the locking ring (202).

16. The cap according to claim 15, wherein the movement element of the free portion (306) is made like a wall in which the enlargement is absent.

* * * * *